US007673934B2

(12) United States Patent
Bearup et al.

(10) Patent No.: US 7,673,934 B2
(45) Date of Patent: Mar. 9, 2010

(54) DUAL PURPOSE HIGH CHAIR

(75) Inventors: Adam D. Bearup, Shillington, PA (US); Curtis M. Hartenstine, Birdsboro, PA (US); Joseph F. Fiore, Jr., Lebanon, PA (US); Sharon A. Gillett, Salem, OR (US)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 12/145,310

(22) Filed: Jun. 24, 2008

(65) Prior Publication Data

US 2009/0001776 A1 Jan. 1, 2009

Related U.S. Application Data

(60) Provisional application No. 60/937,175, filed on Jun. 26, 2007.

(51) Int. Cl.
*A47D 1/10* (2006.01)

(52) U.S. Cl. ..... 297/130; 297/250.1; 297/256.16; 297/344.14; 297/451.3

(58) Field of Classification Search ..... 297/130, 297/153, 250.1, 256.16, 334.14, 344.18, 297/451.3

See application file for complete search history.

(56) References Cited

U.S. PATENT DOCUMENTS

| | | | | | |
|---|---|---|---|---|---|
| 2,465,104 | A * | 3/1949 | Kullack | 297/338 |
| 2,642,121 | A * | 6/1953 | Frick | 297/344.14 |
| 2,731,072 | A * | 1/1956 | Post | 297/134 |
| 2,779,389 | A | 1/1957 | Pearl | 297/327 |
| 4,733,909 | A * | 3/1988 | Single et al. | 297/256.13 |
| 4,743,063 | A * | 5/1988 | Foster, Jr. | 297/130 |
| 4,750,783 | A * | 6/1988 | Irby et al. | 297/256.16 |
| 5,165,755 | A | 11/1992 | Rho | 403/62 |
| 5,230,523 | A * | 7/1993 | Wilhelm | 297/250.1 |
| 5,265,931 | A * | 11/1993 | Ryan | 297/130 |
| 5,806,922 | A | 9/1998 | Mendelovich | 280/642 |
| 5,951,102 | A | 9/1999 | Poulson | 16/113.1 |
| 6,000,753 | A * | 12/1999 | Cone, II | 297/256.16 |
| 6,050,643 | A | 4/2000 | Kain | 280/647 |
| 6,676,213 | B1 * | 1/2004 | Dlugos | 297/256.11 |
| 6,719,371 | B2 | 4/2004 | Yoshie | 280/642 |
| 2003/0151285 | A1 * | 8/2003 | Keegan et al. | 297/256.13 |
| 2006/0250005 | A1 | 11/2006 | Keegan | 297/256.13 |

FOREIGN PATENT DOCUMENTS

| | | |
|---|---|---|
| EP | 0387764 | 9/1990 |

* cited by examiner

*Primary Examiner*—Peter R. Brown
(74) *Attorney, Agent, or Firm*—Miller Law Group, PLLC

(57) ABSTRACT

A high chair is convertible into multiple operative configurations to provide flexibility in utilization. The high chair includes a youth chair having a seat member affixed to a Z-shaped frame. A booster seat including a reclining seat back is mountable on the seat member such that the seat member is nested within the booster seat. A latch mechanism carried by the booster seat secures the booster seat to the seat member. A separate base member can also be nested into the bottom of the booster seat so that the booster seat can be utilized on a standard chair. The tray is mountable into the booster seat so that the tray can be utilized therewith irrespective of whether the booster seat is used in a high chair configuration or a booster seat configuration. The Z-frame incorporates telescopic support legs to define height adjustment for the high chair.

23 Claims, 8 Drawing Sheets

DUAL PURPOSE HIGH CHAIR

CROSS-REFERENCE TO RELATED APPLICATIONS

This application claims priority on U.S. Provisional Patent Application Ser. No. 60/937,175, filed on Jun. 26, 2007, the contents of which are incorporated herein by reference.

FIELD OF THE INVENTION

The present invention relates generally to a child's high chair and, more particularly, to a high chair configuration that can be used in multiple stages of a child's life.

BACKGROUND OF THE INVENTION

Different products are used by parents to aid in the positioning of their children to facilitate feeding them from the time the child is an infant until the child is old enough and large enough to sit at a table properly. One such product is a high chair, which is typically used to support infants and small toddlers at an elevated position so that the caregiver can easily feed the child. Another such product is a booster seat that is typically attached in a detachable manner to a standard chair so that the child is elevated on the chair to reach a normal table. Booster seats are typically used with older toddlers.

The high chair is a self-standing unit that provides a safe and secure seating area with a feeding tray that is removable from the high chair to facilitate the placement of the child on the high chair and to facilitate the cleaning of the tray and high chair structure. High chairs can incorporate height adjustment mechanism so that the seat can be vertically positioned to fit various table heights so that the tray mechanism could be removed from the high chair and the child positioned on the high chair be pushed up to a table. The booster seats typically attach to the standard chair with one or two adjustable straps so that the booster seat can be removed when no longer in use. The typical booster seat positions the child about three or four inches above the chair seat to locate the child at the table. Some booster seats are provided with height adjustment to fit various table heights. Some booster seats are adapted to receive a tray mechanism so that the booster seat can be utilized away from the table.

The product to be used at meal time to seat a child will depend on the time of day and the family circumstances. For example, if a single caregiver is at home, a self-standing high chair moved to a medium height position may be the product of choice at mid-day to locate the child facing the caregiver while the caregiver is seated nearby. The high chair could be moved to a highest height if the caregiver is standing nearby, such as in the process of preparing a meal for the rest of the family. At the evening meal, the booster seat or the high chair in the lowest position may be chosen so that the child could be seated at the family table. Traveling presents additional problems that can be solved through the use of a portable booster seat.

The age of the child will influence the product selected for use in seating the child to eat. Typically, smaller, younger children use high chairs because the high chair provides a higher seated position for the child and the child is light enough for the caregiver to pick up and place into the elevated high chair seat. As the child grows, the child no longer needs the extra seated height and is normally heavier, and thus more difficult to pick up. In such cases, the booster seat is usually the product of choice.

The high chair disclosed in U.S. Pat. No. 5,165,755, granted to Angelo Rho on Nov. 24, 1992, includes a base stand constituted by two foldable arms on which is mounted a chair that slides on top of and is supported by the foldable arms. The Rho high chair structure can be disassembled and the base stand folded to reduce space required for storage. Similarly, the child's chair disclosed in U.S. Pat. No. 6,719,371, granted on Apr. 13, 2004, to Toshiro Yoshie includes a removable seat apparatus that attaches to a mounting structure affixed to a foldable support base. The Yoshie child's chair provides a height adjustable chair mechanism that includes a compact folded storage configuration.

A convertible high chair, including a base and a chair attachable to the base by means of mechanical fasteners, is disclosed in U.S. Pat. No. 5,806,922, granted on Sep. 15, 1998, to Israel Mendelovich, in which the support base can be disassembled to define a youth chair that has a lower seating surface than the high chair configuration that uses the full support base structure. The base and the chair in the Mendelovich patent are adapted to be assembled separately, such that the base and the chair may be much more compactly stored than previous convertible high chairs. U.S. Pat. No. 5,951,102, issued on Sep. 14, 1999, to Keith Poulson provides a high chair that is convertible to a booster seat. The booster seat has an attachment mechanism that engages tubes of the support frame at the seat bottom and seat back to convert the booster seat into a high chair. The seat position relative to the frame of the high chair is adjustable between an upright position and a reclined position. Similarly, the juvenile chair in U.S. Pat. No. 6,050,643, issued to James Kain on Apr. 18, 2000, can be separated from the support stand and utilized as a booster seat.

It would be desirable to provide a high chair structure that will provide greater flexibility in utilization in high chair and in booster chair configurations.

SUMMARY OF THE INVENTION

It is an object of this invention to provide a high chair that can be alternatively used as a booster seat and as a youth chair in different configurations.

It is another object of this invention to provide a high chair that includes a youth chair on which is mounted a booster seat to define a high chair configuration.

It is a feature of this invention that the booster seat can be removed from the youth chair to convert the high chair into a youth chair and a separate booster seat.

It is another feature of this invention that the seating member of the youth chair will nest into the underside of the booster seat.

It is still another feature of this invention that the booster seat incorporates a latch mechanism to selectively engage the nested youth chair seat member.

It is an advantage of this invention that the latch mechanism is spring-loaded and operable from outside the booster seat structure.

It is another advantage of this invention that the high chair can be utilized in several different configurations to provide flexibility in use.

It is still another advantage of this invention that the booster seat can be selectively mounted on the youth chair seat member or on a similarly configured base member that can be attached to a standard chair.

It is a further feature of this invention that the tray for the high chair is mounted into the booster seat.

It is a further advantage of this invention that the tray can be utilized with the booster seat irrespective of whether the booster seat is mounted on the youth chair or on a separate base member.

It is still another object of this invention to provide a booster seat with a recline mechanism that can be moved from a high chair frame to a separate base member that is detachably supported on a standard chair.

It is yet another feature of this invention that the infant booster seat having a recline mechanism built into the booster seat can be moved from a high chair frame to a separate base member.

It is yet another object of this invention to provide a juvenile chair apparatus that provides an infant seat booster seat that can be slectively detachably connected to a high chair frame support or, respectively, to a remote base member that is detachably connected to a chair or other remote support base.

It is yet another advantage of this invention that the high chair frame incorporates a height adjustment mechanism to permit a vertical positioning of the high chair.

It is still another feature of this invention that the high chair frame is configured into a Z-shape to define a pair of telescopic support legs that provide a height adjustment capability.

It is a further object of this invention to provide a high chair that is convertible into a youth chair and into a booster seat through a simple manipulation of a latch apparatus.

It is a further advantage of this invention that the high chair can be converted with a minimum of effort.

It is yet another object of this invention to provide a convertible high chair structure that is durable in construction, inexpensive of manufacture, carefree of maintenance, facile in assemblage, and simple and effective in use.

These and other objects, features and advantages are accomplished according to the instant invention by providing a high chair that is convertible into multiple operative configurations to provide flexibility in utilization. The high chair includes a youth chair having a seat member affixed to a Z-shaped frame. A booster seat including a reclining seat back is mountable on the seat member such that the seat member is nested within the booster seat. A latch mechanism carried by the booster seat secures the booster seat to the seat member. A separate base member can also be nested into the bottom of the booster seat so that the booster seat can be utilized on a standard chair. The tray is mountable into the booster seat so that the tray can be utilized therewith irrespective of whether the booster seat is used in a high chair configuration or a booster seat configuration. The Z-frame incorporates telescopic support legs to define height adjustment for the high chair.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
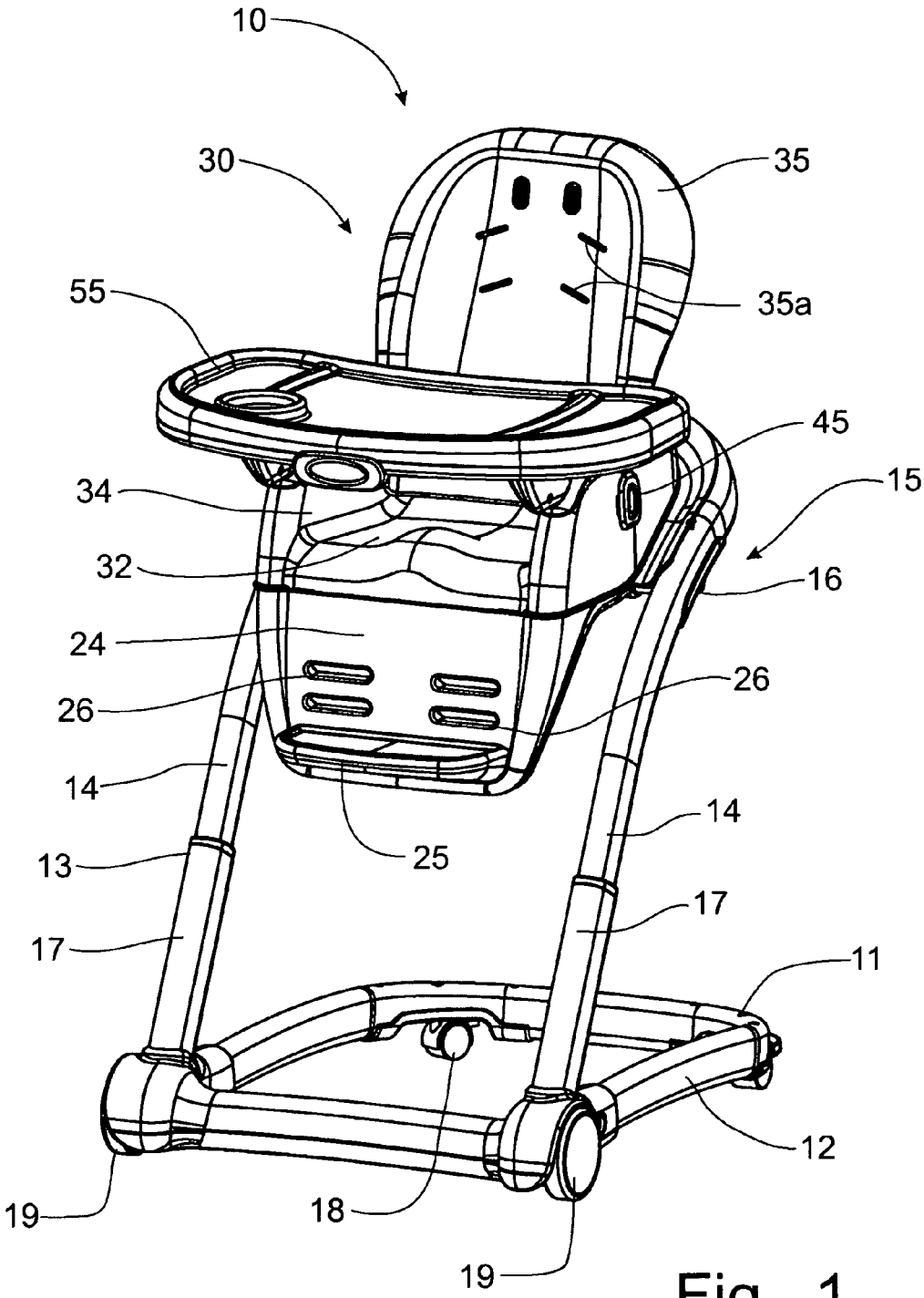
FIG. 1 is a front perspective view of a high chair incorporating the principles of the instant invention.

Referring now to the drawings, a convertible high chair incorporating the principles of the instant invention can best be seen. In terms of general structure, the high chair 10 includes a Z-shaped frame II that has a base portion 12 and a generally vertically extending upright portion 13 that meets the base portion 12 at an acute angle. The upright portion 13 includes a pair of laterally spaced base legs 17 that receive respective telescopic legs 14 that can be optionally spring-biased to an extended position to offset the weight of the booster seat 30 and a child that can be seated in the booster seat 30. The position of the telescopic legs 14 relative to the base legs 17 is controlled by a height adjustment latch mechanism 15 having an actuator 16 supported on each of the telescopic legs 14. The base portion 12 is preferably equipped with a set of fixed wheels 19 at the joint between the base portion 12 and the base legs 17 of the upright portion 13, and a pair of caster wheels 18 to provide mobility to the Z-frame 11.

Figure 2:
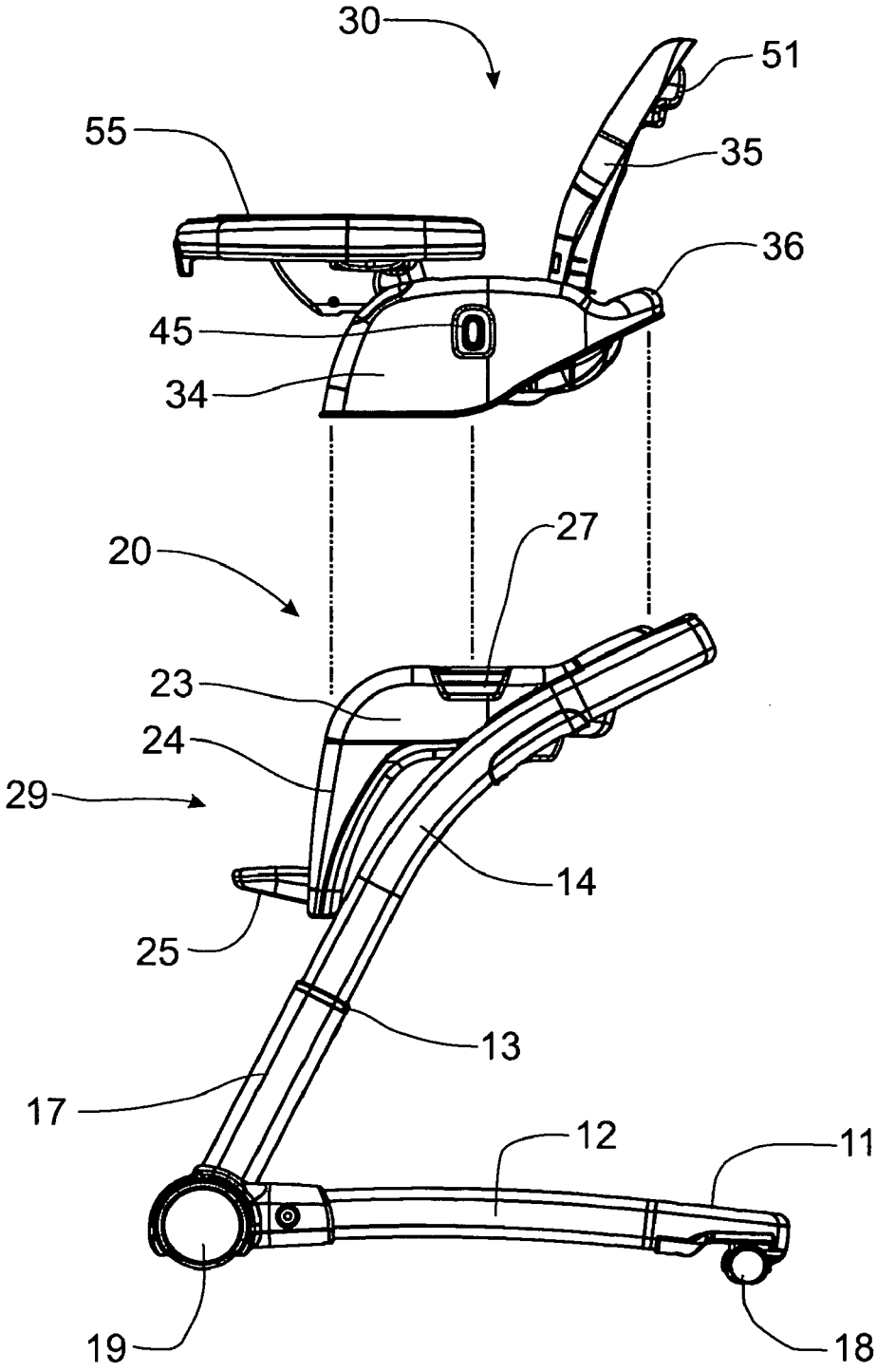
FIG. 2 is an exploded left side elevational view of the high chair shown in FIG. 1, the infant booster seat being separated from the youth chair seat member.
Figure 3:
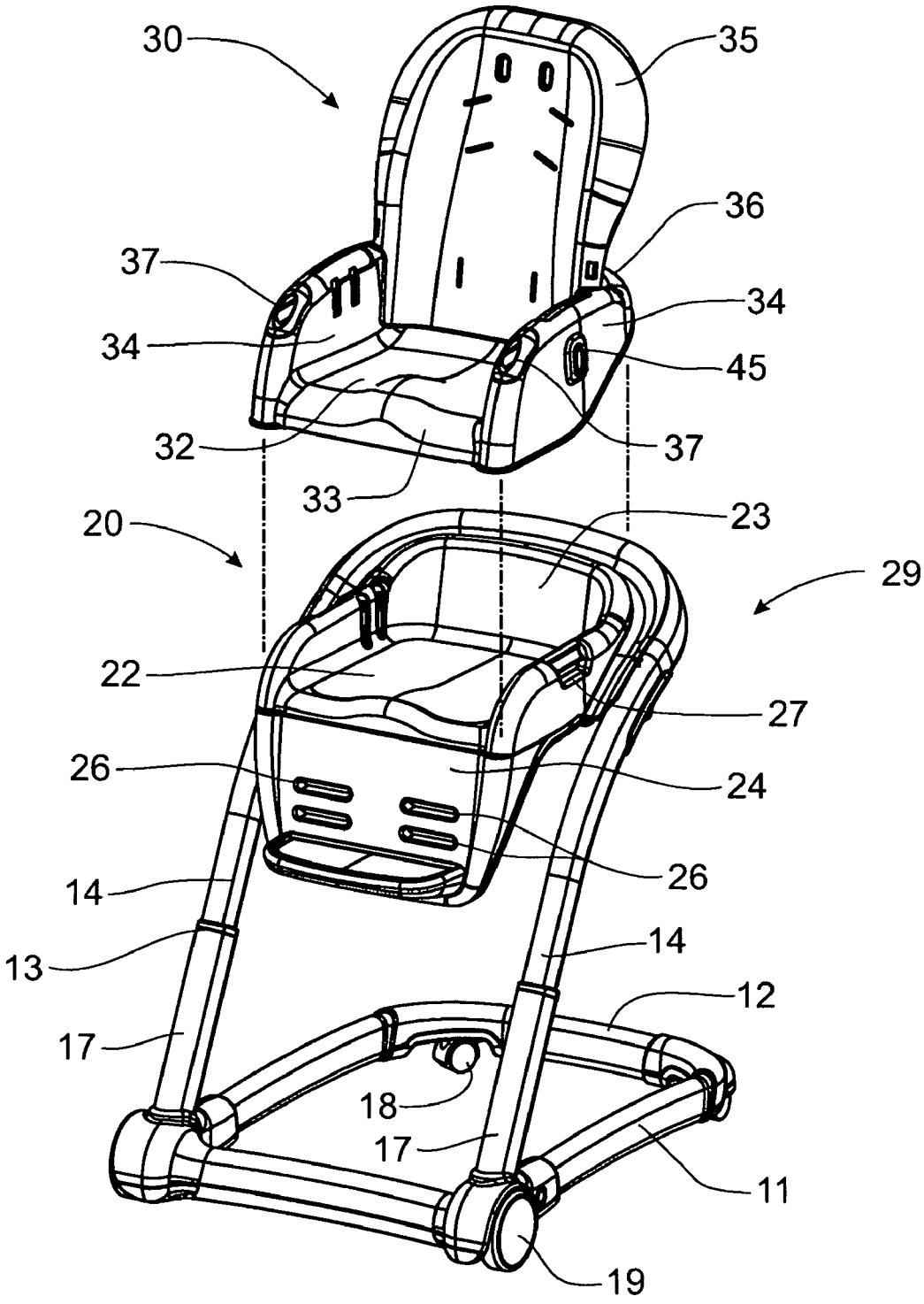
FIG. 3 is an exploded front perspective view of the high chair shown in FIG. 2 with the tray removed for purposes of clarity.

The Z-frame 11 supports a seat member 20 at an upper portion thereof. The seat member 20, as best seen in FIGS. 2 and 3, is formed with a generally horizontal seat portion 22, which is surrounded on the two lateral sides and the back by an upright side wall 23. The front of the seat member 20 is open to accommodate the legs of a child seated on the seat portion 22, but is formed with a foot rest support 24 that extends downwardly from the forward edge of the seat portion 22. The foot rest support 24 is preferably formed with a plurality of vertically spaced pairs of horizontally oriented mounting slots 26 into which a foot rest 25 can be inserted for selective positioning according to the size of the child being supported on the seat member 20, either directly or via the infant booster seat 30, as is described in greater detail below. The seat member 20 is supported on the Z-frame 11, but positioned such that the side wall 23, particularly along the back portion of the seat member 20, is spaced from the Z-frame 11, which preferably curves from one telescopic leg 14 to the other.

In the form shown in FIGS. 2 and 3, with the infant booster seat 30 being removed from the seat member 20, the seat member 20 and Z-frame 11 form a youth chair 29 that will provide a vertically adjustable seat for a young child to sit at the family table. Since the height adjustment latch 15 is mounted within the telescopic legs 14 of the Z-frame 11, the height of the seat member 20 relative to any fixed object, such as the family table (not shown), can be positionally adjusted to the comfort of the child supported thereon. If the child's legs are too long to be supported on the foot rest 25, the foot rest 25 can be removed from the seat member 20.

As can be seen in FIGS. 1-3, the infant booster seat 30 is mounted on the seat member 20 to provide a high chair 10 configuration. The infant booster seat 30 is formed in a mating configuration to the seat member 20 and includes a seat portion 32 and vertical arm rests 34 on opposing lateral sides of the seat portion 32. The front edge of the seat portion 32 is formed with a curved return 33. A back rest 35 extends upwardly from the rearward edge of the seat portion 32 to provide a back support for a child seated on the seat portion 32 of the infant booster seat 30. The back rest 35 includes slots 38 for the insertion of harness members (not shown) to secure the child in the booster seat 30. As is best seen in FIG. 2, the structure of the side arm rests 34 curves behind the back rest 35 to define a rear curved support 36.

The structure of the arm rests 34, the front return 33 and the rear curved support 36 defines a hollow receptacle that is shaped and sized to mate with the side wall 23 of the seat member 20. When the infant booster seat 30 is mounted on the seat member 20, the side wall 23 is nested into the arm rests 34 and the rear curved support 36 with the seat portion 32 of the infant booster seat 30 being positioned on top of the seat portion 22 of the seat member 20. The curved front return 33 of the infant booster seat 30 curves down over the front edge of the seat portion 22 of the seat member 20.

Each of the arm rests 34 is provided with a latch mechanism 40, best seen in FIGS. 6-8A. The latch mechanism 40 includes an actuator button 45 that protrudes horizontally from a trim piece 45a mounted on the outside of each of the arm rests 34. The latch mechanism 40 includes a latch member 42 that can be integrally molded with the actuator button 45 and includes a pivot 43 supported on the respective arm rest 34. Below the pivot 43 is a latch hook 44 that is oriented to be engagable with the latch keeper slot 27 formed in each of the side walls 23. The latch member is biased by a spring 46 supported in the arm rests 34 above the pivot to urge the lower latch hook 44 into engagement with the latch keeper slots 27. When the actuator button 45, which is located above the pivot 43 in opposition to the spring 46, is depressed into the arm rest 34, the biasing force exerted by the spring 46 is overcome, the spring is compressed and the latch hook is released from the latch keeper slots 27, thus allowing the infant booster seat 30 to be lifted off of the seat member 20, as is depicted in FIGS. 2 and 3.

Figure 7:
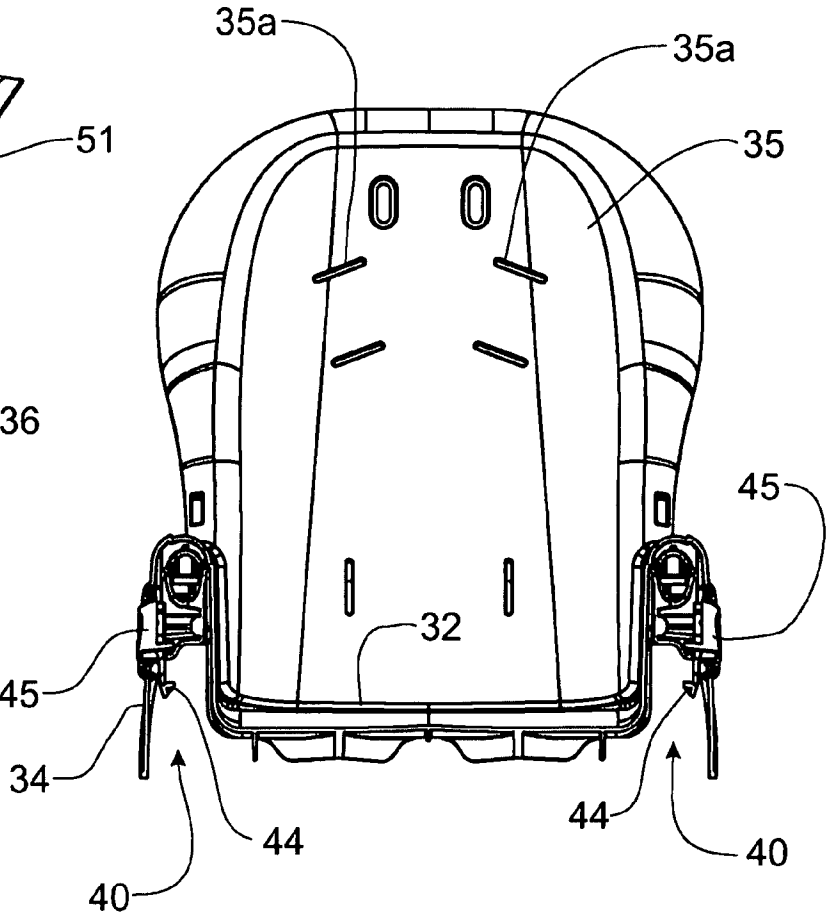
FIG. 7 is a cross-sectional view of the booster seat taken along lines 7-7 of FIG. 6 to shown the nesting configuration of the booster seat and an elevational view of the latch mechanism.
Figure 6:
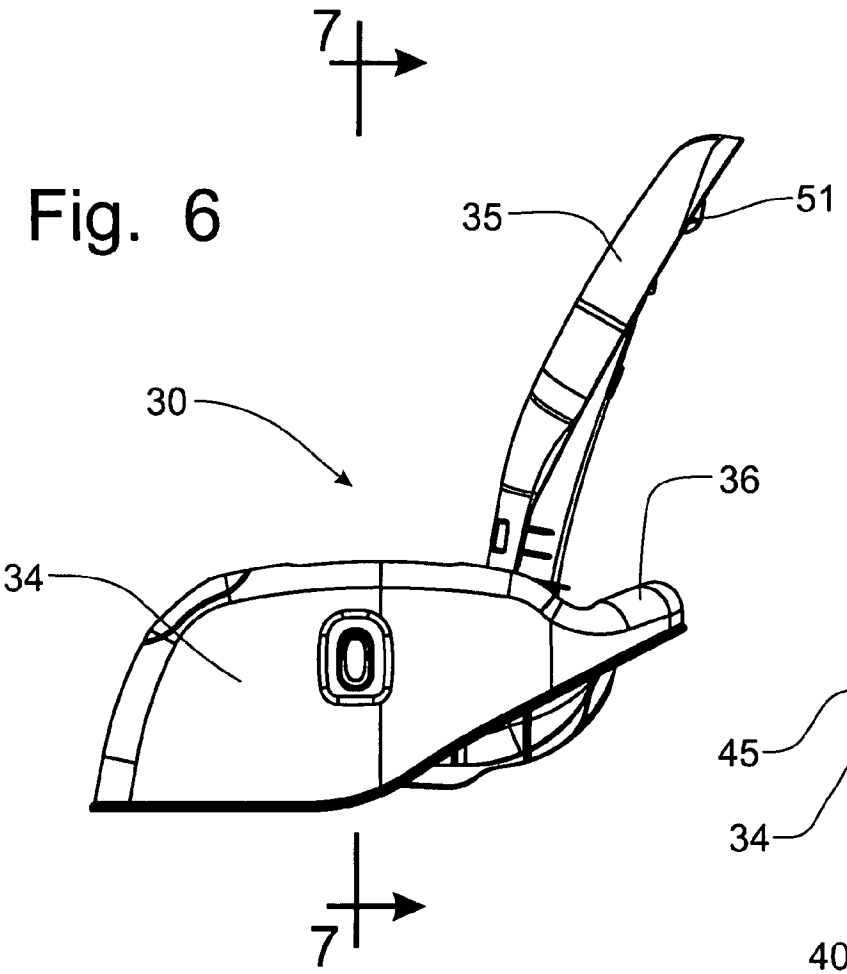
FIG. 6 is a side elevational view of the booster seat.
Figure 8A:
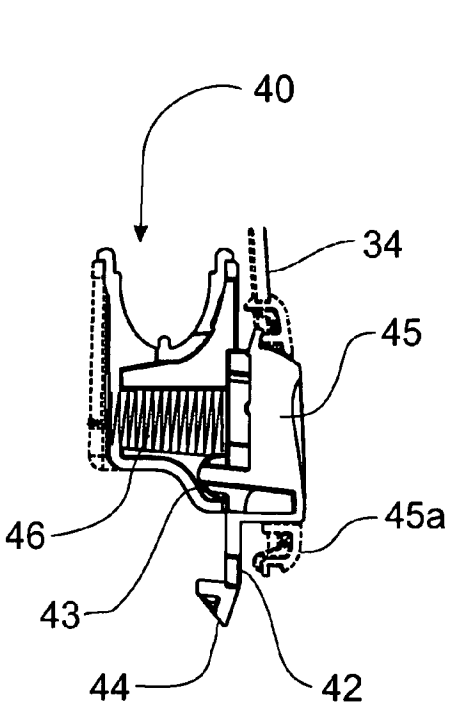
FIG. 8A is an enlarged front elevational view of the latch mechanism mounted within the left arm rest of the infant booster seat, adjacent structure of the left arm rest being shown in phantom.
Figure 8:
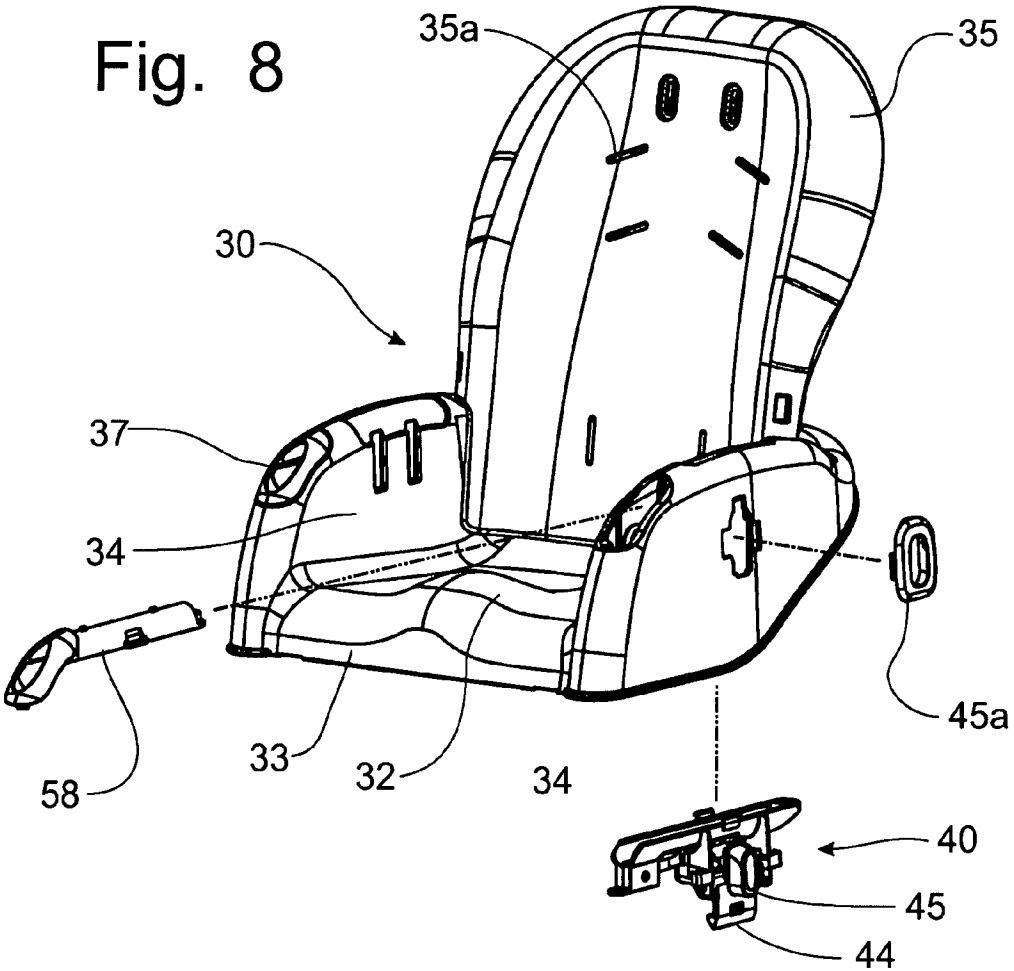
FIG. 8 is an exploded view of the booster seat showing the latch mechanism and the tray support sleeve as mounted in the booster seat.
Figures 9, 10:
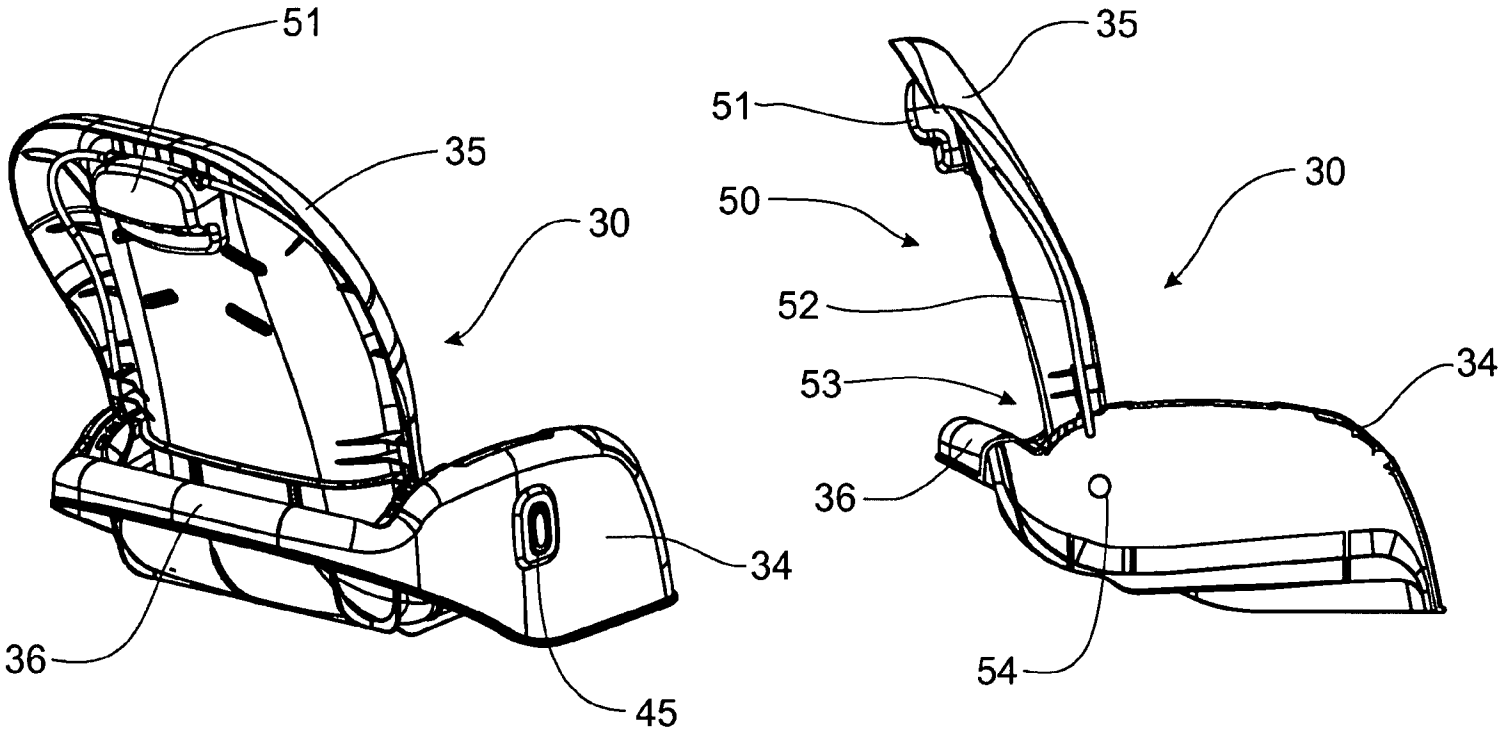
FIG. 9 is a rear perspective view of the infant booster seat.
FIG. 10 is a partial cross-sectional view taken through the right arm rest of the infant booster seat to depict the recline latch mechanism for the seat back of the infant booster seat.
Figures 11, 12:
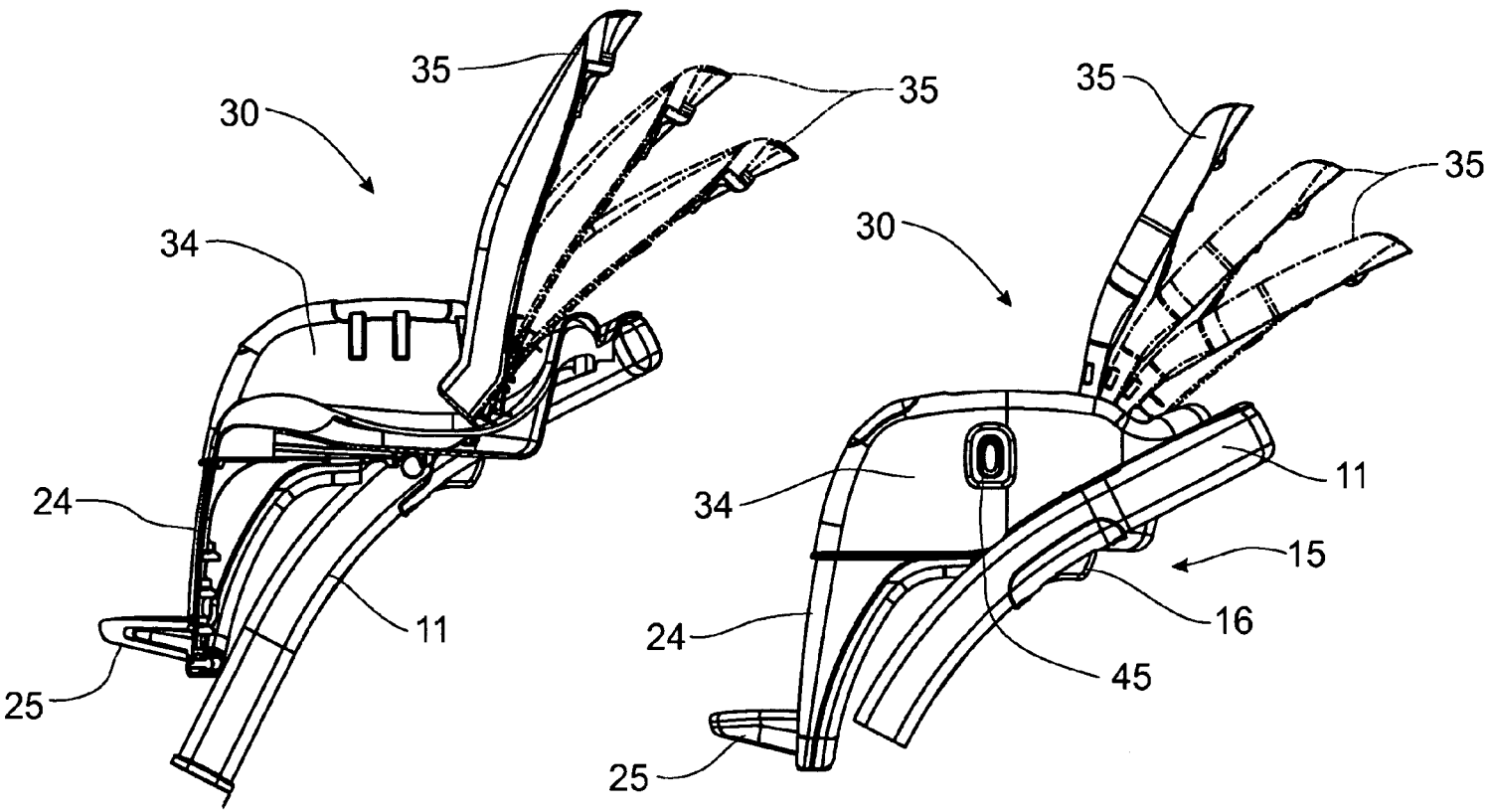
FIG. 11 is a partial cross-sectional view of the high chair taken along the longitudinal centerline of the high chair to show the recline movement of the seat back of the infant booster seat, the two recline positions of the seat back being shown in phantom.
FIG. 12 is a partial left side elevational view of the high chair to show the movement of the seat back of the infant booster seat, the recline positions of the seat back being shown in phantom.

As can be seen best in FIG. 7, the latch hook 44 is shaped to define a lower cam surface that will ride over the side wall 23 urging the latch hook 44 outwardly and compressing the spring 46 and increasing the biasing force exerted thereby. When the infant booster seat 30 is slid over top of the seat member 20, the latch hooks 44 are deflected outwardly automatically until aligned with the latch keeper slot 27, at which time the force of the spring 46 snaps the latch hook 44 into the latch keeper slot 27 to secure the infant booster seat 30 onto the seat member 20. Depressing the actuator buttons 45 allows the latch hooks 44 to release from the latch keeper slots 27 and permits the infant booster seat 30 to be lifted off the seat member 20.

The seat back 35 is preferably formed to be reclined from a vertical orientation throughout a range of reclined positions. As can be seen in FIGS. 9-12, the recline mechanism 50 includes an actuator handle 51 located on the rear side of the seat back 35. The actuator handle 51 is coupled to an elongated locking pin 52 that extends from the actuator handle 51 within the structure of the seat back 35 to engage latch openings 53 formed in the rearward part of the seat portion 32 to lock the seat back in a selected recline position, as shown in phantom and solid lines in FIGS. 11 and 12. To operate, the actuator handle 51 is lifted to disengage the locking pin 52 from the engaged latch opening 53. The seat back 35 is then moved to the desired position about the pivot 54 mounted between the opposing arm rests 34, and the actuator handle 51 can be returned to the latching position to re-engage the locking pin 52 with the corresponding latch opening 53.

The infant booster seat 30 is also provided with receptacles 37 in the arm rests 34 to receive the mounting supports (not shown) of the tray 55. A mounting sleeve 58 can be inserted into the receptacles 37 to engage the mounting supports and provide a stronger support than the molded plastic arm rest 34 can provide to resist the forces exerted on the cantilevered tray mechanism 55. Furthermore, the mounting sleeve 58 can be slotted to provide a latch keeper (not shown) for the retention of the tray 55 within the mounting sleeve 58.

Figure 5:
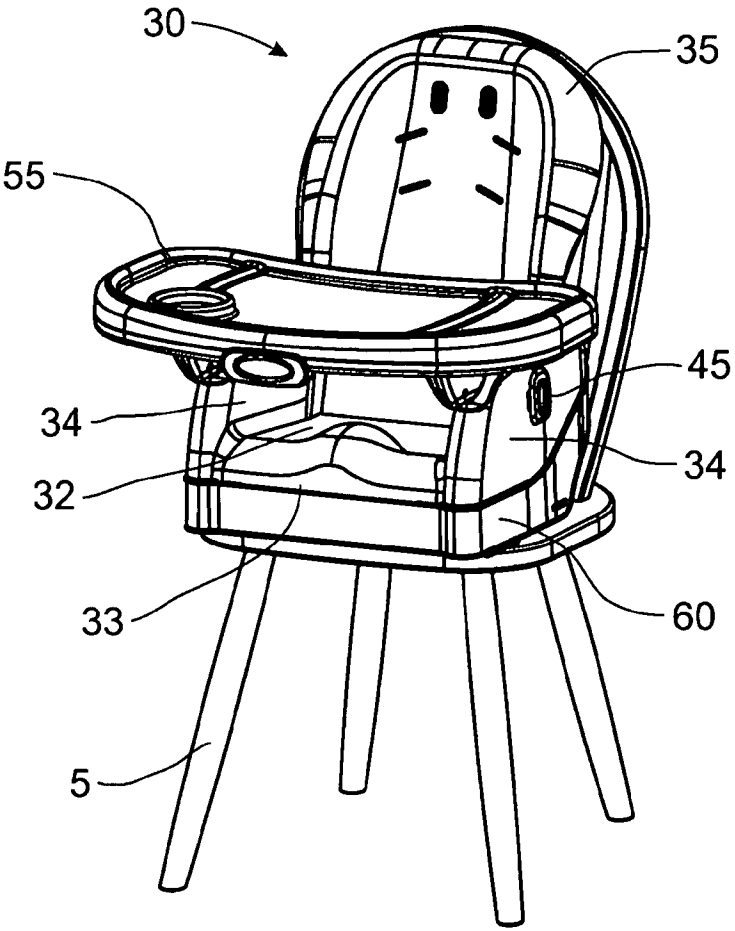
FIG. 5 is a front perspective view of the base member shown in FIG. 4 with the booster seat mounted thereon, the tray being mounted in the booster seat.

Once the infant booster seat 30 is removed from the seat member 20, the seat member 20 and the attached Z-frame II becomes a youth seat, as noted above. The infant booster seat 30 can be mounted on a remote base member 60 that is configured substantially identically to the seat member 20, with a seat portion 62 and upright side wall 63. The side walls 63 are also formed with latch keeper slots 64 that are positioned for engagement with the latch look 44 of the latch mechanism 40. As seen in FIG. 5, the mounting of the infant booster seat 30 on the base member 60, which is detachably connected to a standard chair 5 via conventional connecting straps (not shown), provides an elevated booster seat configuration. Since the tray mechanism 55 is mounted on the infant booster seat 30, the tray 55 can be selectively deployed when the infant booster seat 30 is on the base member 60.

Figure 4:
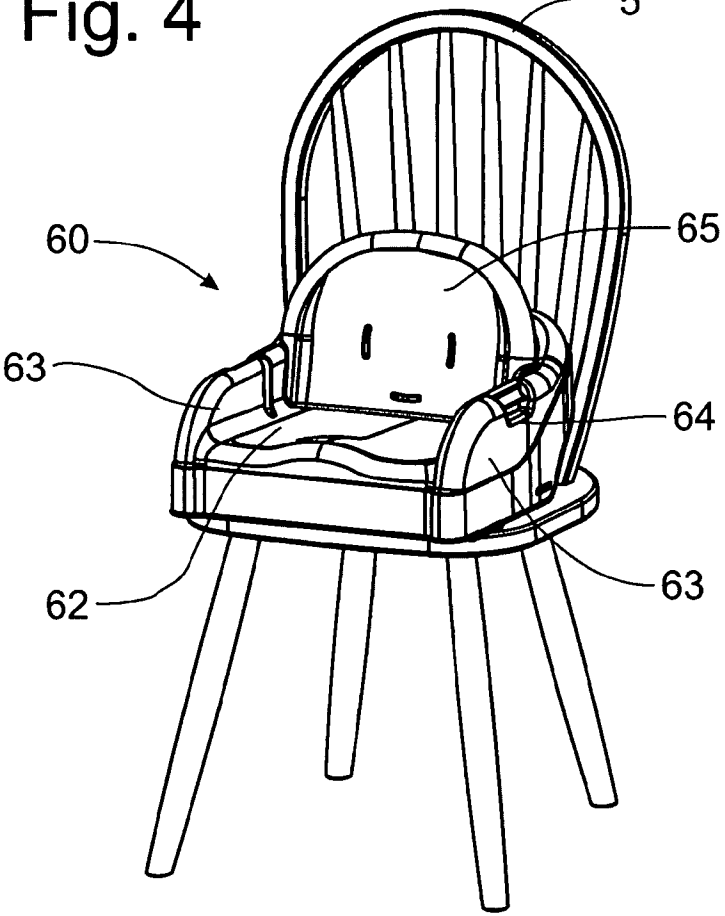
FIG. 4 is a front perspective view of a separate base member detachable supported on a standard chair, the base member being configured similarly to the youth chair seat member to nest inside the bottom of the booster seat.

Preferably, as is depicted in FIG. 4, the base member 60 can be used independently as a child booster seat without the infant booster seat 30 being mounted thereon. The seat portion 62 of the base member 60 is preferably formed with a plurality of vertically oriented slots (not shown) to receive a variably positionable low seat back member 65. The low seat back member 65 is located inside the side wall 63 and can be selectively located in fore-and aft spaced slots (not shown) to provide appropriate support for a child seated on the base member 60. If the infant booster seat 30 is to be mounted on the base member 60, the low seat back 65 is removed from the base member 60 so that the side wall 63 can be nested within the hollow arm rests 34 and curved rear support 36 of the infant booster seat 30.

Accordingly, one of ordinary skill in the art will recognize that the high chair 10 incorporating the principles of the instant invention can be quite flexible in utilization thereof. The high chair configuration with the infant booster seat 30 mounted on the seat member 20 provides a vertically positionable high chair for an infant or a toddler. Once the infant booster seat 30 is removed from the seat member 20, the seat member 20 and Z-frame 11 define a youth chair 29. As with the base member 60 described above, the provision of appropriate generally vertical mounting slots (not shown) would enable the use of a low seat back 65 on the seat member 20. The infant booster seat 30 can alternatively be mounted on the base member 60 that is detachably connected to a standard chair 5 to provide a child booster seat with a removable tray apparatus 55. Independently, the base member 60 can be utilized as a child booster seat for a child that is larger than one needing the extra height provided by the mounted infant booster seat 30.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, one of ordinary skill in the art will recognize that the seat member 20 could be formed to be selectively removable from the Z-frame 11 to provide the independent base member 60. While such a configuration of the invention would prevent multiple simultaneous uses of the youth chair 29 and the youth booster seat 60, such a configuration would eliminate the need for an independent base member.

Having thus described the invention, what is claimed is:

1. A high chair comprising:

a frame having a base portion including a pair of spaced base legs and a generally upright portion extending upwardly from said base portion at an acute angle thereto and including a pair of telescopic legs received respectively within said base legs to be generally vertically movable relative to said base legs;

a support member mounted on said telescopic legs of said upright portion and having upright walls extending upwardly from said support member to a first height dimension; and an infant booster seat selectively mountable on said support member and having a seat portion including arm rests defining arm rest cavities into which said upright walls are nested when mounted on said support member, each said arm rest carrying a latch mechanism engagable with said support member to restrict vertical movement of said infant booster seat relative to said support member.

2. The high chair of claim 1 wherein said support member is formed with a seat portion configured to seat a child without mounting said infant seat booster thereon.

3. The high chair of claim 2 wherein said upright walls of said support member include opposing side walls and a rear wall, said infant booster seat including a seat back defining hollow seat back cavities for the nesting of corresponding said rear wall of said support member, each said latch mechanism being operable to engage said corresponding side wall portions of said support member to secure said infant booster seat on said support member.

4. The high chair of claim 3 wherein each said latch mechanism comprises:

a latch member pivotally supported within the corresponding said arm rest, said latch member including a latch hook forming a lower portion of said latch member;

a spring member engaged with an upper portion of said latch member to bias said latch hook into engagement with said corresponding side wall portion of said seat member; and an actuator button selectively operable to overcome said bias exerted by said spring member to allow said latch hook to disengage said corresponding side wall portion of said seat member.

5. The high chair of claim 2 wherein infant booster seat is positionable on a remote base member configured to nest within said infant booster seat, said infant booster seat including a latch mechanism operable to engage said remote base member.

6. The high chair of claim 5 wherein said base member is formed with a seat portion, both said support member and said base member being formed with a side wall extending generally vertically around a perimeter of said seat portion along opposing side edges of said seat portion, each said seat portion being configured to seat a child without mounting said infant seat booster thereon.

7. The high chair of claim 2 wherein said infant booster seat further includes a seat back pivotally supported relative to said seat portion, said seat back being pivotally movable into a plurality of reclined positions.

8. The high chair of claim 7 further comprising a recline latch mechanism engagable with said seat portion to restrain said seat back in a selected reclined position.

9. The high chair of claim 2 wherein said infant booster seat supports a detachable tray including support arms received within said arm rests.

10. The high chair of claim 9 wherein each said arm rest includes a mounting sleeve secured to the corresponding said arm rest to receive the support arms of said detachable tray.

11. The high chair of claim 1 further comprising a height adjustment latch apparatus mounted in said telescopic legs and engagable with said base legs to control the position of said telescopic legs relative to said base legs.

12. The high chair of claim 1 wherein said telescopic legs are connected by a curved rear portion, said support member being spaced from said curved rear portion and from said telescopic legs to accommodate the mounting of said infant booster seat.

13. A juvenile chair apparatus comprising:

a seat member supported on a frame at an elevated position, said seat member having a first configuration including a first seat portion and a first side wall extending generally vertically around a perimeter of said first seat portion along opposing side and rear edges of said first seat portion;

a remote base member having a second configuration similar to said first configuration and including a second seat portion and a second side wall extending generally vertically around a perimeter of said second seat portion along opposing side and rear edges of said second seat portion; and an infant booster seat selectively mountable respectively on said seat member and said base member, said infant booster seat including a third seat portion configured to nest on top of the first and second seat portions, respectively, of said seat member and said base member when mounted thereon, said infant booster seat including a pair of arm rests and a back rest defining cavities for the nesting of corresponding side wall portions respectively of said seat member and said base member.

14. The juvenile chair apparatus of claim 13 wherein said infant booster seat includes a latch mechanism operable to engage respectively said seat member and said base member.

15. The juvenile chair apparatus of claim 14 wherein both said seat member and said base member are operable to support a child on the corresponding said seat portion without having said infant booster seat mounted thereon.

16. The juvenile chair apparatus of claim 15 wherein said seat back is pivotally supported relative to said third seat portion so as to be pivotally movable into a plurality of reclined positions.

17. The juvenile chair apparatus of claim 16 further comprising a recline latch mechanism engagable with said third seat portion to restrain said seat back in a selected reclined position.

18. The juvenile chair apparatus of claim 15 wherein said infant booster seat supports a detachable tray including support arms received within said arm rests.

19. The juvenile chair apparatus of claim 15 wherein said frame includes:

a base portion;

a pair of laterally spaced base legs connected to said base portion; and a pair of telescopic legs received respectively within said base legs to be generally vertically movable relative to said base legs, said seat member being mounted on said telescopic legs.

20. The juvenile chair apparatus of claim 19 further comprising a height adjustment latch apparatus mounted in said telescopic legs and engagable with said base legs to control the position of said telescopic legs relative to said base legs.

21. The juvenile chair apparatus of claim 15 wherein each said latch mechanism comprises:

a latch member pivotally supported within the corresponding said arm rest, said latch member including a latch hook forming a lower portion of said latch member;

a spring member engaged with an upper portion of said latch member to bias said latch hook into engagement with said corresponding side wall portion respectively of said seat member and said base member; and an actuator button selectively operable to overcome said bias exerted by said spring member to allow said latch hook to disengage said corresponding side wall portion respectively of said seat member and said base member.

22. A juvenile chair apparatus comprising:

a frame including an elevated first support member including a pair of opposing first upright side walls and a first upright rear wall;

a remote second support member selectively attachable to a corresponding support base, said second support member including a pair of opposing second upright side walls and a second upright rear wall; and an infant booster seat selectively mountable on said first and second support members to provide a seating surface for a juvenile when respectively mounted on said first and second support members, said infant booster seat including a pair of opposing arm rests defining cavities to receive selectively said first and second upright side walls, in a nesting relationship when mounted thereon, said arm rests having a latch member mounted thereon to engage said first and second support member, respectively, to secure said infant booster seat thereon, said infant booster seat further including a seat back defining a cavity to receive selectively said first and second upright rear walls in a nesting relationship when mounted thereon, said infant booster seat being configured to provide a seating member independently of said first and second support members.

23. The juvenile chair apparatus of claim 22 wherein each of said first and second support members is formed with a seat portion that will accommodate a juvenile seated on said seat portion without said infant booster seat being mounted thereon.

* * * * *